United States Patent [19]

De Gelder et al.

[11] 4,102,501

[45] Jul. 25, 1978

[54] DEFLECTOR ASSEMBLY FOR A SPRAY GUN

[75] Inventors: Jacob De Gelder, Rancho Palos Verdes; William Harvey Hill, Carson; Ronald F. Englhard, Mission Viejo, all of Calif.

[73] Assignee: The Leisure Group, Los Angeles, Calif.

[21] Appl. No.: 751,533

[22] Filed: Dec. 16, 1976

[51] Int. Cl.[2] ..... B05B 1/26

[52] U.S. Cl. ..... 239/511; 239/515; 239/523

[58] Field of Search ..... 239/505, 514, 507–512, 239/516, 515, 517, 523

[56] References Cited

U.S. PATENT DOCUMENTS

| | | | |
|---|---|---|---|
| 1,022,643 | 4/1912 | Schellenger | 239/511 |
| 1,152,652 | 9/1915 | McBoyle | 239/509 |
| 2,676,062 | 4/1954 | Hamilton | 239/509 |
| 2,850,326 | 9/1958 | Kofford | 239/513 |
| 3,003,706 | 10/1961 | Thorne | 239/511 |
| 3,050,261 | 8/1962 | Littlefield | 239/511 X |
| 4,014,471 | 3/1977 | McGrane | 239/510 |

*Primary Examiner*—John J. Love

*Attorney, Agent, or Firm*—Harold L. Jackson; Stanley R. Jones; Joseph W. Price

[57] ABSTRACT

A deflector assembly for a spray gun includes a mounting collar and a pivotable deflector blade. The mounting collar has a plurality of locking tines, or fingers, for permanent snap engagement about a spray nozzle. The mounting collar further includes a support tube with a pivotable groove on an upper surface and a pair of locking detents on a lower surface. The mounting collar is rotatable about the spray nozzle. The deflector blade comprises a locking retainer having a pivotal shoulder of a complementary shape to that of the pivotal groove of the mounting collar. The deflecting blade further includes a camming or prong lock capable of interengaging with the locking detents on the mounting collar. The deflector blade includes a plate member extending from the locking retainer having a planar impact surface on one side and a serrated surface on the other. The deflector assembly is permanently attached to the spray gun and the deflector blade can be pivotally moved into and out of the flow pattern to provide a desired water distribution.

16 Claims, 6 Drawing Figures

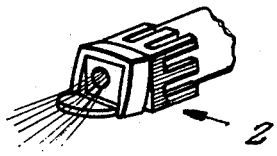
FIG. 2
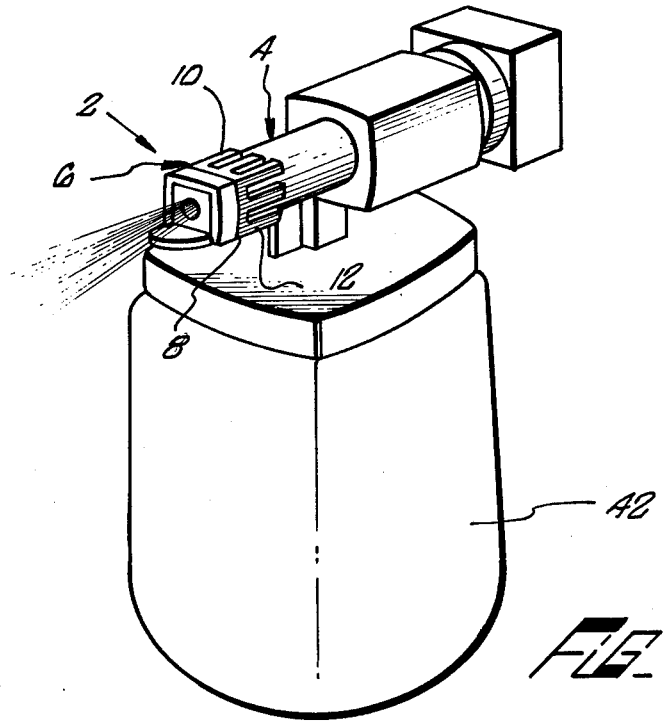
FIG. 1
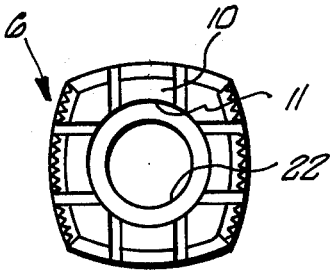
FIG. 5
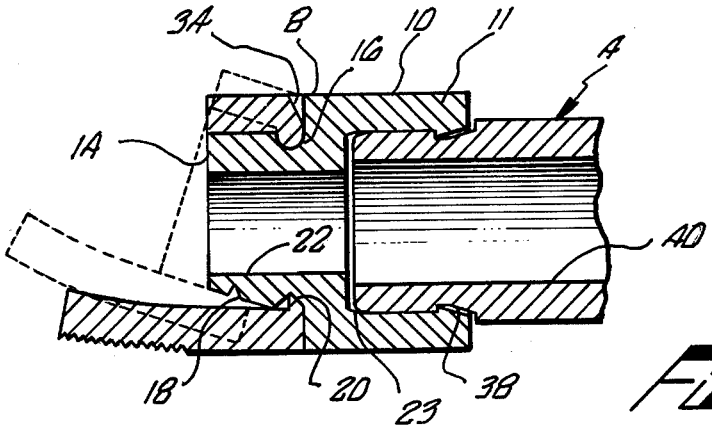
FIG. 6
FIG. 4
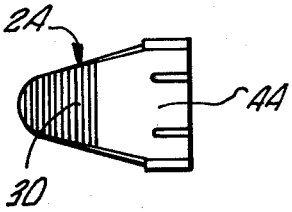
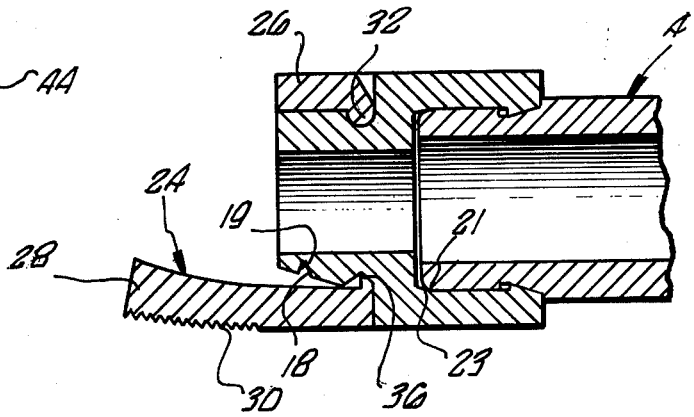
FIG. 3

DEFLECTOR ASSEMBLY FOR A SPRAY GUN

BACKGROUND OF THE INVENTION

1. Field of the Invention

The present invention is directed to a sprayer apparatus of general use in agricultural and horticultural applications, and more particularly, to a deflector assembly mounted on the sprayer apparatus.

2. Description of the Prior Art

Sprayers have been extensively utilized both in the agricultural and horticultural field. A common form of sprayer is hand-held and includes a venturi nozzle that is connected to a suitable receptacle capable of holding an appropriate fluid, such as liquid fertilizer, plant vitamins, insecticides, etc.

Frequently, it is necessary to vary the spray pattern of the fluid passing through the nozzle. Various arrangements have been suggested in the prior art such as the Dunmire U.S. Pat. No. 3,930,617, Lindgren U.S. Pat. No. 3,648,928, Owbridge U.S. Pat. No. 2,530,779 and Harmon U.S. Pat. No. 3,888,417 for regulating water flow by placing a deflector in the water stream emitting from the nozzle. Frequently, these deflectors will be separated from the nozzle and become lost.

The prior art has yet to provide a relatively inexpensive deflector assembly for a hand-held sprayer which can be permanently attached to the sprayer nozzle and selectively used as desired.

SUMMARY OF THE INVENTION

The present invention is directed at a deflector assembly that can be easily combined with a sprayer nozzle in an economical manner. The deflector assembly comprises a deflector blade and an annular mounting collar having a plurality of snap locking fingers capable of coacting with an annular groove extending about the sprayer nozzle.

The deflector blade is pivotally connected to the mounting collar and can be selectively placed within the flow pattern of the fluid emitting from the nozzle to produce the desired fluid distribution. The deflector blade is attached to a locking retainer having a pivotal shoulder of complementary shape to that of a planar pivotal groove on the mounting collar. The deflecting blade further includes a camming or prong locking member capable of interengaging with appropriate locking detents on the mounting collar. The design of the deflector blade is such that it can be easily press mounted onto the mounting collar. The locking detents are located on the collar to provide one position with the deflector blade out of the flow pattern and other position with the deflector blade fixed in the flow pattern.

The mounting collar is rotatable about the sprayer nozzle to adjust the radial position of the deflecting blade. This rotation is facilitated by an oversize dimension of the annular groove on the sprayer nozzle which permits a relative axial movement of the mounting collar and the sprayer nozzle.

If back flushing of the sprayer is required, the internal bevelled or tapered configuration of the mounting collar bore is such that when the mounting collar is biased by an external force against the face of the nozzle body there will be no leakage of fluid through the fitting.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is a perspective view of the present invention;

FIG. 2 is a perspective view of the deflector assembly of the present invention;

FIG. 3 is a cross-sectional view of the deflector assembly in a back flush position; FIG. 4 is a cross-sectional view of the deflector assembly in an operational position;

FIG. 5 is a rear view of the deflector mounting collar, and

FIG. 6 is a bottom view of the deflector blade.

DESCRIPTION OF THE PREFERRED EMBODIMENT

The following description is provided to enable any person skilled in the prior art to make and use the invention and sets forth the best mode comtemplated by the inventor of carrying out his invention. Various modifications, however, will remain readily apparent to those skilled in the art since the generic principles of the present invention have been defined specifically to provide a relatively inexpensive and easily manufactured deflector assembly.

Referring to FIG. 1, the present invention relates to a sprayer and more particularly to a unique deflector assembly 2 which is mounted on the sprayer nozzle 4.

The deflector assembly 2 includes a mounting collar 6 having an annular collar 8 which supports a plurality of cantilevered locking fingers or tines 10. Appropriate serrations 12 can be provided on the exterior surface of the mounting collar 6 to permit an operator to grasp and rotate it to any desired position about 360°.

Extending on the other side and forward of the annular collar 8 is a support tube 14 having an upper planar groove or pivotal mounting connector 16 and a series of lower locking detents 18 and 20 with a radii originating from the center of the pivotal hinging member 32. A bore 22 extends axially through the mounting collar 6.

A deflector blade 24 includes a locking retainer 26 and a blade body 28 having serrations 30 on its exterior surface, for the purpose of permitting the operator to change the position of the deflector blade 24. The locking retainer 26 has an elongated round pivotal shoulder or pivotal hinge member 32 that is complementary to the upper planar groove 16. A tapered sloping surface 34 is cut at an appropriate angle to prevent restriction in the movement of the deflector blade 24. The locking retainer 26 further has a locking cam or prong 36 supported on a locking blade tine 44 relatively movable to the locking retainer 26 that is compatible with the respective detents 18 and 20 on the support tube 14. The locking detent 18 includes a shoulder portion 19 to prevent any further clockwise movement of deflector blade 24 and thereby lock it on the mounting collar 6. The position detent 20 permits a removable storage of the deflector blade 24 out of the water stream. Both of the detent positions are radially equivalent from the hinge member 32. The impact surface of the blade body 28 has a curvilinear impact surface to permit a relatively low angular impact interface with the emitted water to prevent dripping at the spray nozzle. Thus the operator is further protected from dripping contact with the chemicals being distributed by the water stream.

The sprayer nozzle 4 includes an annular sloping groove 38 that is bounded by first and second parallel walls. The exterior edge of the sprayer nozzle 4 has a bevelled or tapered surface which is complementary to a corresponding tapered surface in the interior of the mounting collar 6.

The sprayer nozzle 4, mounting collar 6, and deflector blade 24 can be formed by molding an appropriate plastic material or any material appropriate to the desired function.

During assembly, the resiliency of the snap locking fingers 10 easily permit locking heads 11, on the snap locking fingers, to be biased radially outward as the nozzle 4 is inserted into a female coupling with the mounting collar 6 as can be seen in FIG. 5. The locking heads 11 engage in the annular groove 38. The relative size of the locking heads 11 and the annular groove 38 permit a relative axial movement of the mounting collar 6 and the sprayer nozzle 4.

Frequently, it is desirable to back flush the sprayer, and this is commonly accomplished by simply blocking the flow of water through the deflector assembly 2, for example with the operator's finger. When this is accomplished, there is no venturi action, and water is forced into the suction tube, thereby flushing out any chemicals or particles remaining. When the mounting collar 6 is forced backward as shown in FIG. 3, the front surface of the sprayer nozzle 4 as well as the complementary bevelled or tapered surfaces 21 on the sprayer nozzle 4, and on the interior of the collar 8, surface 23, effectively seal the mounting collar 6 to the sprayer nozzle 4.

When it is desired to alter the flow pattern by inserting the deflector blade 24 into the fluid stream emitting from the bore 22, the operator can simply transversely pivot the deflector blade 24 until the locking prong or tine 36 engages the upper locking detent 18. The deflector blade 24 pivotally rotates about the upper planar groove 16 on the support tube 14. With the deflector blade 24 positioned in a deflector mode of operation, as disclosed in FIG. 4 with phantom lines, the desired water distribution is achieved. It is possible to rotate the collar 8 to any radial position desired by the operator.

As can be readily appreciated, the deflector blade 24 can be assembled by force fitting it onto the support tube 14. The deflector blade's 24 unique structure permits it to be permanently retained on the mounting collar 6 in a passive position, or to be optionally positioned into a deflector position to provide the desired water distribution. Thus, an operator need not disassemble the deflector assembly 2 and the possibility of losing a deflector blade and mounting collar is eliminated.

The above specification discloses the preferred embodiment of the present invention, however it should be realized that there are modifications such as material, etc., which can be utilized once taught the generic principles of this invention.

What is claimed is:

1. A deflector assembly adapted to being mounted on a sprayer nozzle comprising;

a mounting collar, capable of being operatively connected to a spray nozzle, having a first pivotal mounting connector and at least a pair of detents, and a deflector blade having a complimentary second pivotal mounting connector operatively connected to the first pivotal mounting connector and a locking tine for selective engagement with the detents, whereby the deflector blade is pivotally mounted on the mounting collar for rotation about the respective mounting connectors to provide at least one deflecting position within the flow pattern of the nozzle.

2. The invention of claim 1 wherein the mounting collar is rotatable.

3. The invention of claim 1 wherein the deflector blade has a curvilinear impact surface.

4. A deflector assembly and sprayer nozzle to provide a fluid flow pattern comprising;

a sprayer nozzle having a first bore therein to transmit fluid and a first locking means;

a mounting collar having a second locking means connected to the sprayer nozzle's first locking means to permit relative axial movement while still in a locked position, the mounting collar further having a second bore therein aligned with the sprayer nozzle's first bore; and a deflector blade pivotally connected to the mounting collar and having a limited range of movement into and out of the flow pattern, the mounting collar additionally has a third locking means for selectively positioning the deflector blade and further includes a pair of detents and the deflector blade further has a locking tine for selective engagement with the detents to subjectively position the deflector blade.

5. The invention of claim 4 wherein the mounting collar further includes a plurality of snap locking members adapted to being attached to the sprayer nozzle.

6. The invention of claim 5 wherein the snap locking members are of such length to permit a relative axial movement of the deflector assembly on the sprayer nozzle.

7. The invention of claim 4 wherein the mounting collar's second locking means includes a plurality of snap locking members and the sprayer nozzle body's first locking means is an annular groove.

8. The invention of claim 4 further including sealing means between the sprayer nozzle body and the mounting collar for sealing the respective parts during back flushing of the assembly.

9. The invention of claim 4 wherein the deflector blade locking tine is cantilevered from the deflector blade.

10. A deflector assembly adapted to be mounted on a fluid sprayer nozzle having an annular groove comprising;

a mounting collar having a plurality of integral snap locking members cantilevered from one side of the mounting collar for engagement with at least the top and bottom of the nozzle annular groove;

a deflector blade pivotally mounted on the mounting collar and capable of diverting the flow pattern of fluid, and locking means including a locking tine and a pair of detents for selective positioning of the deflector blade within the flow pattern of the fluid.

11. The invention of claim 10 wherein the mounting collar has an approximately annular configuration with a planar groove positioned to provide an equal radial distance to each detent.

12. The invention of claim 11 wherein the deflector blade has an approximately annular configuration with a planar rib for engagement with the mounting collar planar groove.

13. The invention of claim 10 wherein the mounting collar includes a first pivotal mounting connector and the deflector blade includes a complementary second pivotal mounting connector, the deflector blade being pivotally mounted for optional rotation about the connectors into the flow pattern.

14. The invention of claim 13 wherein the mounting collar's first pivotal mounting connector is a planar groove.

15. The invention of claim 14 wherein the complementary second pivotal mounting connector is a planar rib member.

16. The invention of claim 10 wherein the mounting collar includes at least a pair of detents and the deflector blade has a relatively movable locking tine for selective engagement with the detents.

* * * * *